US009464872B2

(12) United States Patent
Dyke et al.

(10) Patent No.: US 9,464,872 B2
(45) Date of Patent: Oct. 11, 2016

(54) PROTECTIVE MATERIAL

(71) Applicant: BAE SYSTEMS plc, London (GB)

(72) Inventors: Amy Elizabeth Dyke, South Gloucestershire (GB); Sajad Haq, South Gloucestershire (GB); Caroline Joleen Morley, South Gloucestershire (GB)

(73) Assignee: BAE SYSTEMS plc, Londong (GB)

( * ) Notice: Subject to any disclaimer, the term of this patent is extended or adjusted under 35 U.S.C. 154(b) by 0 days.

(21) Appl. No.: 14/358,795

(22) PCT Filed: Nov. 6, 2012

(86) PCT No.: PCT/GB2012/052755

§ 371 (c)(1),
(2) Date: May 16, 2014

(87) PCT Pub. No.: WO2013/072667

PCT Pub. Date: May 23, 2013

(65) Prior Publication Data

US 2014/0311329 A1 Oct. 23, 2014

(30) Foreign Application Priority Data

Nov. 17, 2011 (GB) ..... 1120031.8

(51) Int. Cl.
*F41H 5/02* (2006.01)
*F41H 5/04* (2006.01)

(52) U.S. Cl.
CPC ..... *F41H 5/0428* (2013.01); *F41H 5/0421* (2013.01); *F41H 5/0435* (2013.01); *F41H 5/0464* (2013.01); *F41H 5/0478* (2013.01); *F41H 5/0485* (2013.01)

(58) Field of Classification Search
CPC ... F41H 5/0485; F41H 5/0464; F41H 5/0478
USPC ..... 89/906, 908, 909, 910, 912, 913
See application file for complete search history.

(56) References Cited

U.S. PATENT DOCUMENTS 3,828,699 A 8/1974 Bowen
4,186,648 A 2/1980 Clausen et al.
4,200,677 A * 4/1980 Bottini et al. ..... 442/254
4,292,882 A * 10/1981 Clausen ..... 89/36.02

(Continued)

FOREIGN PATENT DOCUMENTS

WO 2004103231 A1 12/2004
WO 2006121411 A1 11/2006

(Continued)

OTHER PUBLICATIONS

International Search Report and Written Opinion of the International Searching Authority received for Patent Application No. PCT/GB2012/052755, mailed on Jan. 31, 2013, 15 pages.

(Continued)

*Primary Examiner* — Samir Abdosh
(74) *Attorney, Agent, or Firm* — Finch & Maloney PLLC

(57) ABSTRACT

According to the invention there is provided a protective material for dissipating the kinetic energy of a moving object including a plurality of layers of fibrous armor material in which at least some adjacent layers of fibrous armor material are separated by one or more separator layers for reducing inter-layer friction.

22 Claims, 1 Drawing Sheet

(56) References Cited

U.S. PATENT DOCUMENTS

Figure 1:
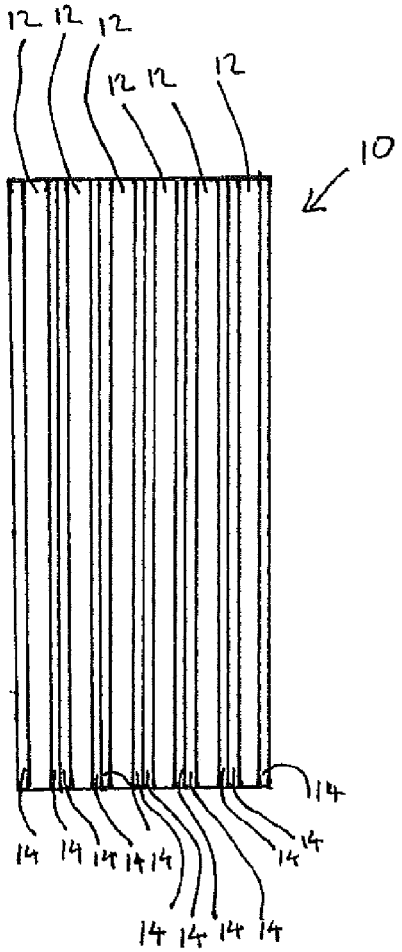

| | | | | |
|---|---|---|---|---|
| 4,404,889 | A * | 9/1983 | Miguel | 89/36.02 |
| 4,539,253 | A * | 9/1985 | Hirschbuehler et al. | 442/239 |
| 4,678,702 | A * | 7/1987 | Lancaster et al. | 428/193 |
| 4,879,165 | A * | 11/1989 | Smith | 428/212 |
| 5,061,545 | A * | 10/1991 | Li et al. | 428/195.1 |
| 5,167,876 | A * | 12/1992 | Lem et al. | 252/602 |
| 5,739,184 | A * | 4/1998 | Marbry et al. | 523/403 |
| 5,796,028 | A * | 8/1998 | Field | F41H 5/0485 89/36.02 |
| 5,854,143 | A | 12/1998 | Schuster et al. | |
| 7,226,878 | B2 | 6/2007 | Wagner et al. | |
| 7,498,276 | B2 | 3/2009 | Wagner et al. | |
| 7,825,045 | B1 | 11/2010 | Wagner et al. | |
| 8,132,494 | B1 | 3/2012 | Nguyen et al. | |
| 8,322,268 | B1 * | 12/2012 | Booher, Sr. | 89/36.02 |
| 8,627,756 | B1 * | 1/2014 | Booher, Sr. | 89/36.02 |
| 2002/0037391 | A1 * | 3/2002 | Harpell et al. | 428/103 |
| 2003/0129900 | A1 * | 7/2003 | Chiou | 442/134 |
| 2004/0094026 | A1 | 5/2004 | Efim et al. | |
| 2005/0266748 | A1 | 12/2005 | Wagner et al. | |
| 2006/0040576 | A1 | 2/2006 | Citterio | |
| 2006/0234577 | A1 * | 10/2006 | Wagner | A41D 31/0061 442/135 |
| 2006/0252325 | A1 | 11/2006 | Matsumura et al. | |
| 2006/0252328 | A1 * | 11/2006 | Bingenheimer | 442/180 |
| 2009/0311930 | A1 * | 12/2009 | Wang et al. | 442/134 |
| 2010/0269236 | A1 | 10/2010 | Wagner et al. | |
| 2010/0275765 | A1 * | 11/2010 | LaGrotta et al. | 89/36.02 |
| 2011/0041675 | A1 * | 2/2011 | Ermalovich | 89/36.02 |
| 2011/0072959 | A1 | 3/2011 | Petrovich et al. | |
| 2011/0113534 | A1 | 5/2011 | Sauer et al. | |
| 2012/0137865 | A1 * | 6/2012 | Citterio et al. | 89/36.02 |
| 2012/0171477 | A1 | 7/2012 | Sang et al. | |
| 2012/0177869 | A1 * | 7/2012 | Micarelli | 428/105 |
| 2014/0311327 | A1 | 10/2014 | Dunleavy et al. | |
| 2014/0311328 | A1 | 10/2014 | Haq et al. | |
| 2014/0311329 | A1 * | 10/2014 | Dyke et al. | 89/36.02 |

FOREIGN PATENT DOCUMENTS

| | | | |
|---|---|---|---|
| WO | 2008061170 | A1 | 5/2008 |
| WO | 2008097362 | A1 | 8/2008 |
| WO | 2010096037 | A1 | 8/2010 |
| WO | 2011112590 | A2 | 9/2011 |
| WO | 2012005785 | A2 | 1/2012 |
| WO | 2013072667 | A1 | 5/2013 |
| WO | 2013072668 | A1 | 5/2013 |
| WO | 2013072669 | A1 | 5/2013 |

OTHER PUBLICATIONS

GB Intellectual Property Office Search Report under Section 17(5) received for GB Patent Application No. 1120031.8 mailed Feb. 17, 2012, 3 pages.

Mayo, et al, "Stab and puncture characterization of thermoplastic-impregnated aramid fabrics," Elsevier, International Journal of Impact Engineering, vol. 36, 2009, pp. 1095-1105.

International Preliminary Report on Patentability and Written Opinion received for Patent Application No. PCT/GB2012/052755, mailed on May 30, 2014, 8 pages.

International Prelim. Report on Patentability and Written Opinion received for Patent Application No. PCT/GB2012/052757, mailed on May 30, 2014, 9 pages.

International Search Report and Written Opinion of the International Searching Authority received for Patent Application No. PCT/GB2012/052757, mailed on Jan. 30, 2013, 15 pages.

GB Intellectual Property Office Search Report under Section 17(5) received for GB Application No. 1120032.6 mailed on Feb. 20, 2012, 3 pages.

Egres, et al., "Stab Resistance of Shear Thickening Fluid (STF)—Kevlar Composites for Body Armor Applications," Proceedings of the 24th Army Science Conference, Orlando, Florida, Nov. 29, 2004 through Dec. 2, 2004, 8 pages.

International Prelim. Report on Patentability and Written Opinion received for Patent Application No. PCT/GB2012/052756, mailed on May 30, 2014, 9 pages.

International Search Report and Written Opinion of the International Searching Authority received for Patent Application No. PCT/GB2012/052756, mailed on Feb. 5, 2013, 16 pages.

GB Intellectual Property Office Search Report under Section 17(5) received for GB Patent Application No. 1120033.4 mailed Feb. 20, 2012, 3 pages.

* cited by examiner

PROTECTIVE MATERIAL

This invention relates to protective material and articles manufactured therefrom.

Body armour is used by personnel in various fields to afford protection against a variety of impact events. The body armour may be intended to provide anti-ballistic protection, ie, protection against projectiles and bodies such as splinters or other fragmentary material moving at high velocity. Also, body armour may be used to provide spike resistance, such as against blades and other sharp weapons, or needles. It is well known to manufacture body armour from a plurality of layers of a polyaramid fabric such as Kevlar®, which is poly(paraphenylene terephthalamide), or a similar material. It has been proposed to improve the properties of this type of body armour by impregnating at least some of the layers of fabric with a shear thickening fluid (STF). Protective material of this type for use in body armour is described in U.S. Pat. No. 7,226,878, U.S. Pat. No. 5,854,143, US2004/0094026 and US2006/0040576. STF's are non-Newtonian fluids which exhibit substantial increases in viscosity under the application of a shearing force. The intention of using fabric which is impregnated with STF as body armour is to improve anti-ballistic properties and flexibility. However, the present inventors have discovered that, in at least some embodiments, the use of layers of aramid fabric which have been impregnated with a STF actually results in a deterioration in anti-ballistic properties.

The present invention, in at least some of its embodiments, addresses the above described problems and desires. It has been found that the approach adopted in the present invention can provide improved results with protective materials which are not impregnated with a STF, as well as protective materials which are impregnated with a STF. Accordingly, the present invention is not limited to protective materials of the type comprising a plurality of layers of fabric impregnated with a STF.

According to a first aspect of the invention there is provided a protective material for dissipating the kinetic energy of a moving object including a plurality of layers of fibrous armour material in which at least some adjacent layers of fibrous armour material are separated by one or more separator layers.

Advantages associated with at least some embodiments of the invention include flexibility, reduced bulkiness, reduced thickness, reduced weight, and improved ballistic properties, such as back face trauma signature, in comparison to conventional protective materials.

Advantageously, the separator layer is a friction reducing layer for reducing inter-layer friction. However, the invention is not limited to the provision of friction reducing layers or to this mechanism of operation.

Preferably, the separator layer is a discrete layer of a material. The material may be formed from a polymeric material. A preferred example of a suitable polymeric material is polyimide.

Alternatively, the material may be a metal or a ceramic such as an organo-metal oxide ceramic.

The discrete layer may be present as a sheet or film.

The discrete layer may be formed at least in part from a fabric. The discrete layer may consist entirely of a fabric layer, or the discrete layer may include a fabric in combination with other components. Examples of discrete layers which include a fabric in combination with other components include fabric composite materials such as polymer encased fabrics.

The discrete layer may be placed between the pair of successive layers of fibrous armour material as a separate layer. Alternatively, intimate contact may be made between the discrete layer and at least one layer of fibrous armour material, such as by adhesion or lamination.

In other embodiments, the separator layer is a coating, such as a polymeric coating, applied to at least one of the layers in said pair of successive layers of fibrous armour material. Other examples of coatings include oils, gels and fluids.

Typically, one or two separator layers are used to separate successive layers of fibrous armour material, although the use of more separator layers is possible.

Advantageously, some or all of the layers in the adjacent layers of fibrous armour material which are separated by the separator layers are impregnated with a shear thickening fluid.

In some embodiments, at least one of the layers in the adjacent layers of fibrous armour material which are separated by the separator layers is not impregnated with a shear thickening fluid.

Preferably, the majority of the layers of fibrous armour material are impregnated with a shear thickening fluid. However, embodiments in which a minority or even none of the layers of fibrous armour material are impregnated with a shear thickening fluid are within the scope of the invention.

All of the layers of fibrous armour material may be impregnated with the shear thickening fluid. However, it may be advantageous to position the plurality of layers of fibrous armour material impregnated with the shear thickening fluid behind and/or in front of one or more layers of fibrous armour material which are not impregnated with a shear thickening fluid.

The shear thickening fluid may include particles suspended in a liquid. The particles may be inorganic particles or polymers as is well known in the art. Examples of particles include silica, other oxides, calcium carbonate, and polymers such as polystyrene and poly(methyl methacrylate) and related copolymers.

The liquid may be an organic liquid, a silicone based liquid or aqueous liquid. Examples of organic liquids include glycols such as ethylene glycol and polyethylene glycol, and ethanol. Examples of silicone based solvents include silicone oils and phenyltrimethicone.

The layers of fibrous armour material are typically each in the form of a suitable textile layer produced by a textile production technique such as weaving. Non-woven textile layers may be used.

The fibrous armour material preferably contains aramid fibres, typically poly (paraphenylene terephthalamide) fibres (Kevlar®). Other high strength fibres which are able to dissipate the kinetic energy of moving objects may be used to form the fibrous armour material. Examples of such fibres include graphite, nylon, glass fibres, nanofibres, and other high strength polymeric fibres such as high strength polyethylene.

According to a second aspect of the invention there is provided an article of body armour including a protective material for dissipating the kinetic energy of a moving object including a plurality of layers of fibrous armour material in which at least one pair of successive layers of fibrous armour material are separated by at least one separator layer.

According to a third aspect of the invention there is provided a vehicle including a protective material for dissipating the kinetic energy of a moving object including a plurality of layers of fibrous armour material in which at least one pair of successive layers of fibrous armour material are separated by at least one separator layer.

The protective material may be present as a lining for a cabin area of the vehicle in order to protect occupants of the vehicle from external moving objects.

The vehicle may be in the form of a motorised land vehicle or an aircraft. Where the vehicle is in the form of an aircraft, the protective material may be present as an engine lining.

According to a fourth aspect of the invention there is provided a flexible structure for mitigating the effects of blast events including a protective material for dissipating the kinetic energy of a moving object including a plurality of layers of fibrous armour material in which at least one pair of successive layers of fibrous armour material are separated by at least one separator layer for.

The flexible structure may be in the form of a tent or a blanket.

Whilst the invention has been described above, it extends to any inventive combination of the features set out above, or in the following description, drawing or claims.

Figure 2:
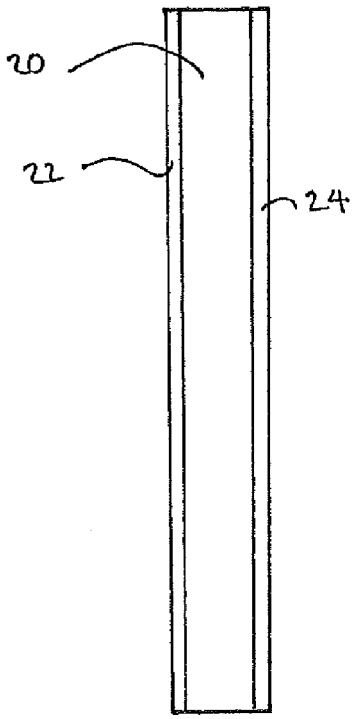

Embodiments of the present invention will now be described, by way of example only, with reference to the accompanying drawings, in which:

FIG. 1 is a cross-sectional view of a protective material of the invention; and FIG. 2 is a cross-sectional view of a layer of fibrous armour material sandwiched between two separator layers.

FIG. 1 depicts a protective material of the invention, shown generally at 10, comprising a plurality of fabric layers 12 formed from fibres of an armour material such as Kevlar®. In some embodiments, all of the fabric layers 12 are impregnated with a STF. However, some or all of the fabric layers may instead be unimpregnated with a STF. Interposed between successive fabric layers 12 are a plurality of separator layers 14. FIG. 2 shows an individual 'unit' of the protective material, comprising a layer 20 of fibrous armour material sandwiched between separator layers 22, 24. Without wishing to be bound by any particular theory or conjecture, it is believed that in at least some embodiments the separator layers may act as friction reducing layers which reduce inter-ply friction in comparison to a protective material in which the separator layers 14 are not present but which is otherwise identical. The separator layers may be polymer films such as polyimide, metallic films, or ceramic films. Examples of ceramic films include organo-metal oxide ceramic films such as an Ormocer®. Fabrics may be used as the separator layers. Alternatively, the fabric layers 12 may be coated with a substance which acts as a separator layer, such as a polymer, oil, gel or fluid.

A number of scale-up tests were performed using 10 layers of Kevlar®. In some examples, samples were prepared using layers of Kevlar impregnated with a silica STF. Colloidal silica in ethylene glycol at a volume fraction of 57% or below was used as the STF. 100 g of the STF was used to impregnate the 10 layers of Kevlar® to provide a number of samples, as shown in Table 1, below. Sample A comprised 10 layers of the STF impregnated Kevlar®, and Sample C comprised 10 layers of the STF impregnated Kevlar® in which the Kevlar® layers were sandwiched between two sheets of polyimide. Similar samples (Samples B and D) were produced using unimpregnated Kevlar®. Sample E comprised 31 layers of unimpregnated Kevlar® with no interleaving polyimide sheets.

TABLE 1

Description of samples used for ballistic testing

| Sample | Number of Kevlar (RTM) Layers | Mass of STF added (g) | Number of polyimide sheets | Areal density (kg/m$^2$) |
|---|---|---|---|---|
| A | 10 | 100 | 0 | 4.60 |
| B | 10 | 0 | 0 | 1.85 |
| C | 10 | 100 | 18 | 5.85 |
| D | 10 | 0 | 18 | 3.17 |
| E | 31 | 0 | 0 | 5.76 |

Ballistic tests were performed on the samples shown in Table 1 according to methodologies which will now be described. The samples were intimately held against the surface of a witness clay block with strips of elastic. The clay block was conditioned prior to testing in a 30° C. oven for three hours and the face of the block was smoothed to ensure a flat surface was provided. A 4.1 g, 10 mm diameter steel spherical projectile was fired at the samples from a gas gun, which is positioned with respect to the clay block to provide a projectile free flight of about 2 m. Careful alignment of the gas gun and target system ensured that the impact on the target was better than ±5 mm of the specified impact point. Prior to impact, the steel projectile passed through a velocity measurement apparatus in the form of two magnetic induction coils. The passage of the projectile through the magnetic field induces a current in the coils. The distance between the coils is known accurately, and hence an estimate of the projectile velocity can be made from the time taken for the projectile to travel between the coils. The method has an accuracy of better than ±2%.

Optical images of the projectile and the deformation of the samples upon impact were captured using a high speed camera positioned obliquely to one side of the target to enable observation of the front face of the sample during impact. The performance of the samples was investigated by comparing the penetration depth and the profile of the penetration of the sample and/or projectile into the clay block. The profile of the penetration is also referred to herein as the back face trauma signature. Measurements of the penetration depth and diameter of the impact area were made from plaster casts of the witness clay using Vernier height callipers. An error of ±1 mm was assigned to each measurement of penetration depth, and an error of ±5% was assigned to the calculation of the impact area. This calculation was made using the diameter of the impact area on the basis of an elliptical impact shape.

Sample A (10 layers of Kevlar® impregnated with STF) suffered perforation with a projectile impact energy of 182 J, with the projectile reaching a depth of 84±5 mm. This is an inferior result to that obtained with Sample B (10 layers of unimpregnated Kevlar®), which was not perforated by projectile impact at an energy of 187 J. Projectile penetration depth was 35 mm and the impact area diameter was 41 mm. Impact performance was significantly improved when STF impregnated Kevlar® layers are separated by polyimide sheets which we believed to act to decrease inter-ply friction (Sample C). In this case, at a projectile impact energy of 188 J, the projectile penetration depth was 19 mm and the impact area diameter was 54 mm Comparison of cast profiles indicates that the combination of STF impregnated Kevlar® layers with polyimide separator sheets (Sample C) reduced the penetration depth by 45±4%, but increased the area deformed by the impact by 80±5%. Moreover, this increase in area is manifest in a significantly reduced gradient of deformation in the clay. Therefore, the combination of STF impregnated Kevlar® layers and polyimide separators results in significantly reduced back face trauma in comparison to an identical number of unimpregnated and unseparated Kevlar® layers. It was found that the first seven layers of Kevlar® had been perforated, indicating that the structure has a lower ballistic threshold than that of 10 layers of unimpregnated and unseparated Kevlar® layers. However, it appears very likely that the combination of 10 STF impregnated Kevlar® layers and polyimide separators (Sample C) results in a higher ballistic threshold than that of 10 unseparated layers of Kevlar® impregnated with STF (Sample A).

When unimpregnated layers of Kevlar® were separated by polyimide sheets (Sample D), a penetration depth of 22 mm and a deformation area of 47 mm were observed at an impact energy of 197 J. Thus, the introduction of polyimide separators has resulted in a reduction of penetration depth by 38±4% and an increase in the area of impact by 29±5% in comparison to a structure formed from the same number of unseparated Kevlar® layers (Sample D in comparison to Sample B). Inspection of the samples after the tests showed that in Sample D, whilst all of the polyimide layers were perforated, there was no indication of yarn fracture of the Kevlar® layers.

Inspection of videos of the samples during impact of the projectile provided an insight into the behaviour of the structures. With Sample B, a great deal of fabric movement is observed during the impact as the fabric is drawn into the point of impact. Separation of the Kevlar® layers with polyimide in Samples C and D reduces the movement of the sample during impact. Instead of moving and stretching during impact and transferring energy between successive Kevlar® layers, perforation tends to occur in Sample C. The reduced penetration depth in Sample D indicates that the energy involved in fracturing the Kevlar® yarns is greater than that absorbed in deformation of the fabric and capture of the projectile.

Sample E was prepared in order to compare the performance of the polyimide separated, STF impregnated Kevlar® layers (Sample C) with an equivalent areal density of unseparated, unimpregnated Kevlar® layers. Sample E gave rise to a penetration depth of 17 mm and an impact area diameter of 45 mm at an impact energy of 195 J. However, although the penetration depth is 10±4% lower than that produced by a similar impact on Sample C, the back face trauma observed is less favourable owing to a very steep gradient. Comparatively, Sample C dispersed the kinetic energy of the impact over an area 59±5% greater than that achieved by Sample E. In addition to the more favourable back face trauma signature exhibited by Sample C, it is noted that the Sample C configuration results in approximately a 50% decrease in thickness in comparison to the Sample E configuration. A related benefit is that there is increased flexibility of the sample.

Integrating STF into Kevlar® layers which are separated by polyimide sheets results in increased energy transfer through the yarns and to adjacent yarns. It has been observed that there is a decrease in ballistic threshold, and it is believed—without wishing to be bound by any particular theory or conjecture—that this effect is due to restriction of the yarns by the STF to such an extent that they 'lock' in place. However, yarn fracture of this kind could be a favourable mechanism for energy absorption. It is envisaged that a protective material could be produced using a combination of STF impregnated armour material layers and unimpregnated armour material layers, in which adjacent layers are separated by friction reducing layers. For example, layers of Kevlar® which are impregnated with STF could be combined with layers of unimpregnated Kevlar® which are positioned in front and/or behind the layers of Kevlar® which are impregnated with STF. In such a system, the STF impregnated layers would absorb kinetic energy and disperse it over a wide area, and the untreated layers would increase the ballistic threshold for impacts in which the layers of STF/Kevlar® composite is defeated. Protective material of this type could be used to provide a layered soft armour system which promises to be thinner, less bulky, more flexible, and exhibit a more favourable back face trauma signature than conventional Kevlar® based soft armour systems.

Numerous variations on the principles and systems disclosed above are within the scope of the invention. For example, it is possible to use fibrous armour material other than Kevlar®. The fibrous armour material can be present as a woven or a non-woven textile layer. The separator layer maybe present as a discrete layer interposed between adjacent layers of the armour material, or it may be in intimate contact with a layer or layers of armour material. Alternatively still, the separator layer may be present as a coating on the armour material.

Protective materials of the invention can be used in a variety of soft body armour systems. The advantageous property of flexibility can be exploited in order to provide body armour to protect regions of the body which are difficult to protect using conventional materials. For example, it is difficult to provide protection for the neck region due to interference between body armour and any headwear worn by an individual, particularly when in a prone position. Protective material of the invention may be used to provide an anti-ballistic and/or spike resistant collar which is sufficiently flexible to address this problem. Protective material of the invention may be combined with other protective systems. For example, the protective material may be placed behind another armour system such as ceramic armour plates to reduce back face trauma. Such systems could increase the extent of the protection offered and/or reduce the thickness of the armour pack. Pouches of protective material may be provided for this purpose. Spike resistant or anti-ballistic body armour can be made using protective material of the invention. A multiple threat armour which provides spike and ballistic protection can be produced using two or more different protective materials, in which an outer structure is configured to mitigate spike threats and an inner structure is configured to provide ballistic protection.

Protective material of the invention can be used for purposes other than body armour. Examples include spall liners for vehicles, blast tents or like structures for blast containment, and engine or turbine linings, especially linings for aircraft engines, for containing detached moving parts or fragments.

The invention claimed is:

1. A protective material for dissipating the kinetic energy of a moving object, the protective material comprising:

a plurality of separator layers; and a plurality of layers of fibrous armour material impregnated with a shear thickening fluid for reducing interlayer friction in which at least some adjacent layers of fibrous armour material are separated by one or more of the separator layers, wherein at least one layer of the fibrous armour material is sandwiched between two of the separator layers, wherein at least one of the layers in the adjacent layers of fibrous armour material which are separated by the separator layers is not impregnated with a shear thickening fluid.

2. A protective material according to claim 1 in which the separator layer is a friction reducing layer for reducing inter-layer friction.

3. A protective material according to claim 1 in which the separator layer is a discrete layer of the separator layer material.

4. A protective material according to claim 3 in which the discrete layer is formed from a polymeric material.

5. A protective material according to claim 3 in which the discrete layer is a sheet or film.

6. A protective material for dissipating the kinetic energy of a moving object, the protective material comprising:

a plurality of separator layers; and a plurality of layers of fibrous armour material impregnated with a shear thickening fluid for reducing inter-layer friction in which at least some adjacent layers of fibrous armour material are separated by one or more of the separator layers, wherein at least one layer of the fibrous armour material is sandwiched between two of the separator layers, and wherein the separator layer is a discrete layer of a metal or a ceramic.

7. A protective material according to claim 3 in which the discrete layer is formed at least in part from a fabric.

8. A protective material for dissipating the kinetic energy of a moving object, the protective material comprising:

a plurality of separator layers; and a plurality of layers of fibrous armour material impregnated with a shear thickening fluid for reducing inter-layer friction in which at least some adjacent layers of fibrous armour material are separated by one or more of the separator layers, wherein at least one layer of the fibrous armour material is sandwiched between two of the separator layers, and wherein the separator layer is a coating applied to at least one of the layers of fibrous armour material.

9. A protective material according to claim 8 in which the coating is a polymeric coating, an oil, a gel or a fluid.

10. A protective material according to claim 1 in which the majority of the layers of fibrous armour material are impregnated with a shear thickening fluid.

11. A protective material according to claim 1 in which the layers of fibrous armour material which are impregnated with a shear thickening fluid are positioned behind and/or in front of one or more layers of fibrous armour material which are not impregnated with a shear thickening fluid.

12. A protective material according to claim 1 in which the shear thickening fluid includes particles suspended in a liquid.

13. A protective material according to claim 12 in which the particles are inorganic particles or polymers.

14. A protective material according to claim 13 in which the particles are silica.

15. A protective material according to claim 12 in which the liquid is an organic liquid, a silicone based liquid or aqueous liquid.

16. A protective material according to claim 15 in which the liquid is ethylene glycol.

17. A protective material according to claim 1 in which the armour material contains aramid fibres.

18. An article of body armour including a protective material according to claim 1.

19. A vehicle including a protective material according to claim 1.

20. A flexible structure for mitigating the effects of blast events including a protective material according to claim 1.

21. A protective material according to claim 1 in which at least one of the separator layers is adjacent to only one layer of the fibrous armour material.

22. A protective material according to claim 1 in which at least two of the separator layers abut each other.

* * * * *